US010060178B2

(12) United States Patent
Seiling

(10) Patent No.: US 10,060,178 B2
(45) Date of Patent: Aug. 28, 2018

(54) WINDOW AND DOOR SILL, JAMB AND HEAD CONSTRUCTION AND RELATED METHOD

(71) Applicant: VEKA INC., Fombell, PA (US)

(72) Inventor: Kevin A. Seiling, Monaca, PA (US)

(73) Assignee: VEKA, INC., Fombell, PA (US)

( * ) Notice: Subject to any disclaimer, the term of this patent is extended or adjusted under 35 U.S.C. 154(b) by 5 days.

(21) Appl. No.: 15/292,365

(22) Filed: Oct. 13, 2016

(65) Prior Publication Data

US 2018/0106095 A1 Apr. 19, 2018

(51) Int. Cl.
*E06B 3/22* (2006.01)
*E06B 7/14* (2006.01)

(52) U.S. Cl.
CPC . *E06B 3/22* (2013.01); *E06B 7/14* (2013.01)

(58) Field of Classification Search
CPC ..... E06B 3/22; E06B 7/14
See application file for complete search history.

(56) References Cited

U.S. PATENT DOCUMENTS 2,714,430 A * 8/1955 Peterson ..... E04B 2/90 52/209
2,714,431 A * 8/1955 Peterson ..... E06B 3/9632 49/504
4,248,018 A 2/1981 Casamayor
4,404,784 A * 9/1983 Gorman ..... E04D 3/365 52/521
4,715,152 A 12/1987 Tanikawa
4,720,955 A * 1/1988 Kane ..... E04D 1/18 52/519
5,038,544 A 8/1991 Traut
5,592,795 A 1/1997 Rinehart et al.
6,405,506 B2 * 6/2002 Ruff ..... E06L 31/12 49/504
7,222,462 B2 5/2007 Ellingson
7,266,929 B1 9/2007 Allred et al.
9,079,380 B2 7/2015 Monteer
2005/0262771 A1 * 12/2005 Gorman ..... E06B 7/14 49/408

(Continued)

FOREIGN PATENT DOCUMENTS

CN 203654994 U 6/2014
DE 29801631 U1 * 3/1998 ..... E06B 3/222

(Continued)

OTHER PUBLICATIONS

Machine_translate_FR2300205 (Year: 1975).*

*Primary Examiner* — Babajide A Demuren
(74) *Attorney, Agent, or Firm* — Eckert Seamans Cherin & Mellott, LLC; Arnold B. Silverman

(57) ABSTRACT

A sill for a window or door has a frame and a panel with a sill frame section defining at least one hollow chamber. A fastener extends through a wall of a hollow chamber and is secured to an adjacent structural member. A plastic element is secured to an interior surface of the sill frame section. The plastic element is disposed between the head of the fastener and a first opening through which the fastener passes to resist passage of water, air and sound through the first opening and into the window and doors. A plastic element is preferably coextruded with the sill frame section. A related method is a similar jamb frame section and a head frame section.

23 Claims, 10 Drawing Sheets

(56) References Cited

U.S. PATENT DOCUMENTS

| | | | | |
|---|---|---|---|---|
| 2006/0086052 | A1* | 4/2006 | Petta | B29C 47/0028 49/404 |
| 2006/0156654 | A1 | 7/2006 | Weiss | |
| 2006/0254151 | A1* | 11/2006 | Curtis | E06B 3/44 49/414 |
| 2007/0289226 | A1 | 12/2007 | Lokkart | |
| 2015/0096235 | A1 | 4/2015 | Rochman | |
| 2016/0053529 | A1* | 2/2016 | Pettibone | E06B 7/14 52/209 |
| 2016/0108668 | A1* | 4/2016 | Volin | E06B 11/02 256/73 |

FOREIGN PATENT DOCUMENTS

| | | | | |
|---|---|---|---|---|
| DE | 10354742 | A1 * | 6/2005 | F16B 33/004 |
| DE | 202016100115 | U1 * | 3/2016 | E06B 7/14 |
| EP | 0867591 | A2 * | 9/1998 | E05D 5/023 |
| FR | 2300205 | A1 * | 9/1976 | E06B 3/9632 |
| FR | 3029557 | A1 * | 6/2016 | E06B 1/045 |
| GB | 2180871 | * | 9/1985 | E06B 7/14 |

* cited by examiner

WINDOW AND DOOR SILL, JAMB AND HEAD CONSTRUCTION AND RELATED METHOD

BACKGROUND OF THE INVENTION

1. Field of the Invention

The present invention relates to improved sill and related jamb and head construction for windows and doors and associated methods and more specifically, it relates to improved means for handling and discharging water therefrom, as well as resisting air and sound passage therethrough, and more specifically, it also relates to a sill which prevents water leakage from the sill into other parts of building construction by providing a faster which passes through a flexible resilient plastic element and on opening in the sill and is secured to adjacent building components.

2. Description of the Prior Art

It has been known in various window and door constructions to have undesired water leakage from frame components into areas where it might cause structural deterioration and aesthetic problems.

The problem is particularly acute where fasteners, such as metal screws or bolts, for example, pass through openings in a sill thereby providing the opportunity for water to seep through such openings into regions where water is not desired and can be damaging. Water leaks can cause mold, mildew and decay problems which are potentially serious. Air leaks waste energy and, in some instances, may cause an undesired, disturbing sound such as whistling. Sound leaks are often of particular importance in respect of city and airport installations.

It has been known to install windows and doors by securing the jambs to the frames in order to resist leakage to the sill and head. Water leaking through the sill into surrounding frame structure can contribute to undesired mold, mildew and decay. Water can also leak from the wall cavity through the head and into the building.

For wider windows and door units, and to resist higher wind load, it is desirable to employ fasteners at multiple points across the sill and head. Such fastening also serves to eliminate to resist crowning at the sill and sagging at the head. One of the problems which emerges from such placing fasteners through the sill and head is that the openings for the fasteners can facilitate undesired water leakage and air and sound passage.

In an effort to solve the foregoing problems, it has been known to provide sill pans, dams and cladding. See generally U.S. Pat. No. 7,222,462 and U.S. Patent Publications 2007/0289226 and 2006/0156654.

U.S. Pat. No. 7,266,929 discloses a threshold positioned above a sub-sill. It discloses several embodiments of the attachable sealing fins which provide a threshold recess. The sealing fin which is said to reduce moisture penetration may be established through a coextrusion employing polyvinyl chloride to provide an extendable and contractible bridging portion.

U.S. Pat. No. 4,715,152 discloses a sill which is secured to a base by means of wood screws and a sealing strip which may be a polyvinyl chloride extrusion. Drain holes are provided to discharge water to the exterior of the window.

U.S. Published Patent Application 2015/0096235 discloses a door sill assembly which has a multi-component sill construction having a flexible seal formed by coextrusion. Drainage channels are said to be provided.

U.S. Pat. No. 4,248,018 discloses two interlocking seal members connected by a flexible hinge with the members said to be coextruded from polyvinyl chloride.

U.S. Pat. No. 5,592,795 discloses a pressure plate which cooperates with glazing gaskets and employs coextrusion and a screw member to secure the assembly.

U.S. Pat. No. 5,038,544 discloses sealing instructions which are said to resist water leakage through holes in sills. A bolt and cooperating nut secure the building component to a building section with an overlying molded plastic cap being secured around the exterior of the hole through which the bolt passes to resist passage of water through the hole.

Despite the foregoing prior art disclosures, there remains a very real and substantial need for a window having a sill construction which will permit fasteners to pass through the sill in securing the sill to a building element while effectively resisting undesired leakage of water from the sill into the adjacent building components. The present invention provides a solution to the foregoing problems.

SUMMARY OF THE INVENTION

The present invention provides a structure and associated method which establishes effective resistance to undesired water leakage from window and door sills. The window or door may have a frame and a panel such as a glazing pane with a sill frame section having at least one hollow chamber. A fastener having a head disposed within a chamber and a shank passing through a first opening in the sill frame section secures the sill frame section to an adjacent structural member. A plastic element is secured to an interior surface of a wall defining a hollow chamber, preferably by coextrusion with the frame extrusion. The fastener passes through the plastic element and the first opening in the wall and is secured to the adjacent structural member. The plastic element is compressed between the interior surface and the fastener head in order to seal the first opening.

In a preferred embodiment, the sill frame section may be composed of a vinyl material such as rigid polyvinyl chloride. Additional materials which may be employed effectively are ABS/ASA (acrylonitrile-butadiene-styrene copolymer/acrylic ester—modified styrene-acrylonitrile terpolymer) and products made of or with glass fibers or glass flakes such as those sold under the trade designation Fiberglas. The plastic element may be composed of a material selected from the group consisting of flexible polyvinyl chloride, thermoplastic elastomers, polysiloxanes, acrylonitrile-butadienes, ethylene propylene diene monomer, styrene butadienes fluorinated hydrocarbons, natural rubber and neoprene.

The plastic element is preferably composed of a compressible and flexible plastic. The plastic element may be elongated and continuous to provide an overlay for a series of relatively spaced first openings through which a plurality of relatively spaced fasteners will pass.

The sill frame section may have a plurality of hollow chambers with a plurality of fasteners passing through a series of first openings therein with the interposed plastic element providing the desired seals.

A further feature of the invention is that selected chamber defining walls may have openings to facilitate delivery of water contained within the sill frame section, directly or indirectly, to the exterior of the sill frame section.

The holes through which the fasteners pass may be preformed or may be formed during passage of the fastener therethrough. The holes are preferably clearance holes so as to resist the frame bowing when the tip of the screw contacts the structural member into which it will penetrate. The fasteners are preferably metal screws and most preferably panhead or truss head screws. Also, concrete screws such as those sold under the trade designation Tapcon are among the suitable fasteners.

It is an object of the present invention to provide an improved sill construction and related jamb and head construction and related method for windows and doors which resists undesired penetration of water through the sill and into other portions of the building construction.

It is a further object of the present invention to provide such a sill construction and related method which will permit the use of penetrating fasteners in securing the sill to adjacent building components while resisting undesired water penetration.

It is a further object of the present invention to avoid prior art inadequacies which required avoidance of the use of through fasteners in the sill such as by securing windows and doors to frames through jambs only.

It is a further object of the present invention to provide systems which are effective with specialty products such as vertically hung windows, horizontal slider windows, sliding patio doors, swing doors, casement windows, tilt turn windows and fixed windows.

It is a further object of the present invention to provide effective sealing through the use of coextrusion of the sealing elements with the sill frame sections.

It is a further object of the present invention to provide improved frame construction and related methods for windows and doors which resist air leaks, sound leaks and crowning.

It is another object of the present invention to provide means for effectively sealing head portions of windows and doors by means of through fasteners to resist undesired sagging of the head and water, air and sound leakage.

These and other objects of the invention will be more fully understood from the following description of the invention on reference to the illustrations appended hereto.

BRIEF DESCRIPTION OF THE DRAWINGS

FIG. 16 is a cross-section of another form of multi-chamber hollow member usable as a jamb, sill and head in a double hung window.

FIGS. 17 and 18 are cross-sectional illustrations of multi-chamber vertically hung sill members.

FIG. 19 is a cross-sectional illustration of an extrusion usable in a horizontal slider windows.

FIG. 20 is a cross-sectional illustration of a multi-chamber hollow patio door sill.

DESCRIPTION OF THE PREFERRED EMBODIMENTS

As employed herein the term "sill" mean a generally horizontally oriented structural member positioned at or adjacent to a lower portion of window, door or other building opening.

Figure 1:
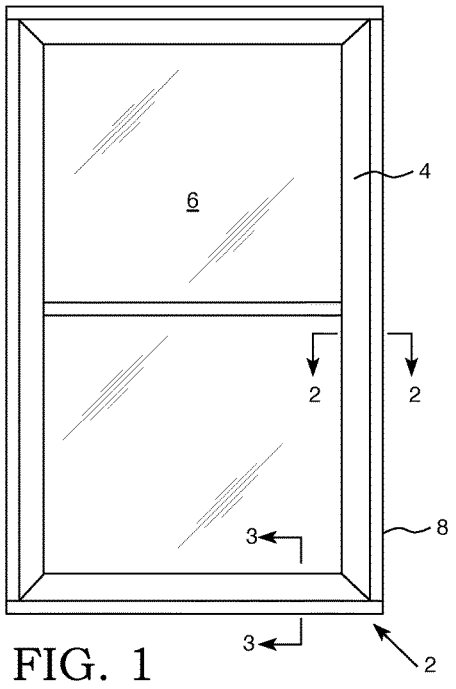
FIG. 1 is a front elevational view of a vertical window.
Figure 2:
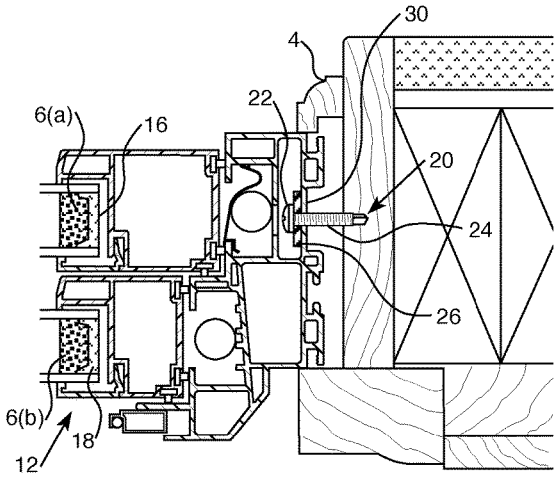
FIG. 2 is a cross-sectional illustration of a portion of the jamb of FIG. 1 taken through 2-2.
Figure 3:
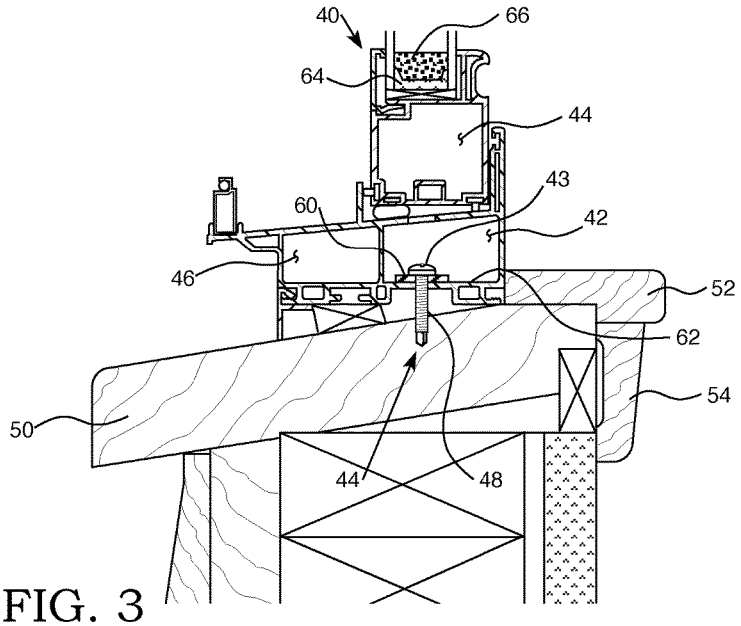
FIG. 3 is a cross-sectional illustration of the window sill taken through 3-3 of FIG. 1.

Referring to FIGS. 1 through 3, there is shown a vertical window 2 which includes a generally rectangular window jamb 4 and a window pane 6 which is secured to a window frame 8.

With reference to one of the two jamb frame sections, FIG. 2 shows a jamb frame section 12 which is taken through 2-2 of FIG. 1. Frame Section 12 is secured to window frame 4 through a series of spaced screws such as screw 20 which passes through an opening in a wall of jamb frame section 12. The window panes 6*a*, 6*b* are received respectively in channels 16 and 18. The screw has a head 22 and shank 24 with a flexible plastic element 26 secured between the screw head 22 and the interior surface of wall 30.

As shown in FIG. 3, a sill frame section 40 has a plurality of hollow chambers 42,46. Chamber 42 has an opening in a lower chamber defining wall through which screw 44 having head 43 and a shank 48 passes with shank 48 engaging support member 50. Molding elements 52,54 are positioned adjacent to sill frame section 40. Plastic element 60 is secured between the underside of screw head 46 and the interior surface 62 of the lower wall of chamber 42. Chanel 64 receives window pane 66. Water entering one of the chambers of jamb frame section 40 will flow under the influence of gravity to the underlying sill and through the sill openings to be described in detail hereinafter will be discharged through the opening.

The window 2 of FIGS. 1 through 3 is illustrated as having exterior wood frame 8 and a welded vinyl window frame 4. In the preferred practice of the invention, the plastic element 26 is coextruded with the adjacent portion of the framing member so as to provide for intimate sealing when the head 22 of screw 20 compresses the same against the interior surface of a hollow chamber defining wall. The screw shank 24 engages an adjacent structural member.

The plastic element 26, 60 is preferably made from a flexible, compressible plastic such as one selected from the group consisting of flexible polyvinyl chloride, thermoplastic elastomers, polysiloxanes, acrylonitrile-butadienes, ethylene propylene diene monomer, styrene butadienes, fluroinated hydrocarbons and natural rubber and neoprene. The plastic element 60 provides for intimate sealing. The plastic element 26, 60 preferably has a width of about ⅜ to ⅝ inches and an uncompressed thickness of about 0.040 to 0.250 inch. Drainage openings may, for example, be present at or adjacent each corner and be rectangular in shape having a dimension of about ¼ inch by 1½ inch. The plastic element 26, 60 is preferably elongated so that it may be positioned adjacent a plurality of openings through which a plurality of fasteners, such as relatively spaced screws, will pass. This construction not only provides for intimate sealing relationships but, also, maintains the fixed position between the sill frame section and the plastic element.

The openings through which the fasteners pass may either be pre-formed or created as the fastener advances through the wall of the hollow chamber.

Figure 4:
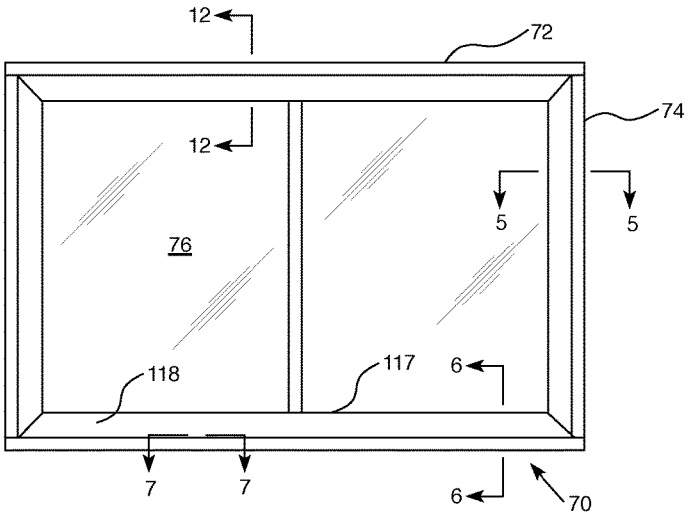
FIG. 4 is a front elevational view of a horizontal sliding window.
Figure 5:
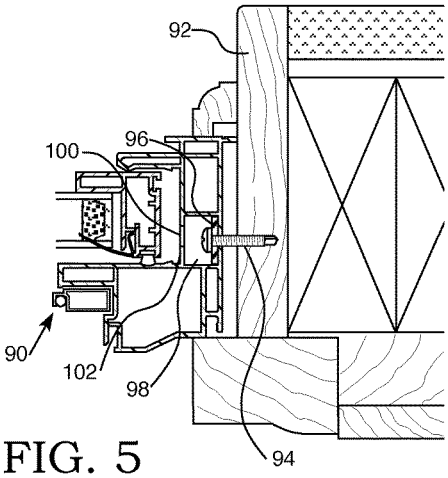
FIG. 5 is a cross-sectional illustration of a portion of the jamb of FIG. 4 taken through 5.5.
Figure 6:
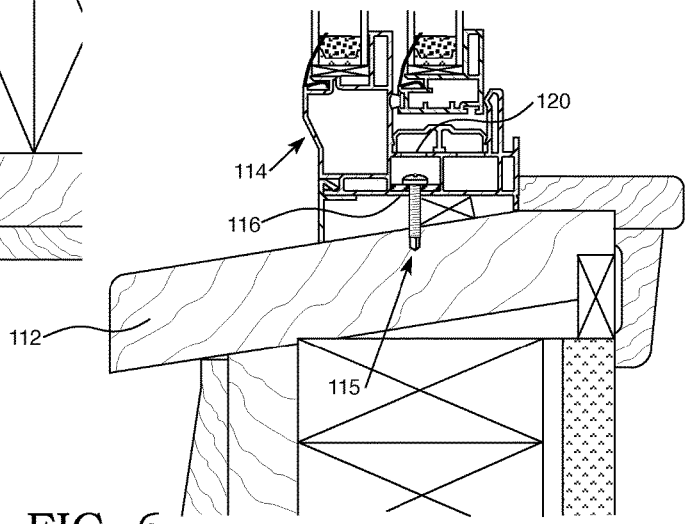
FIG. 6 is a cross-sectional illustration of a portion of the sill of the window of FIG. 4 taken through 6-6.

Referring to FIGS. 4 through 6, there is shown a horizontal window 70 which consists of a wood frame 72 disposed exteriorly of an adjacent vinyl window which has vinyl window frame 74 and panels 76.

The jamb sill frame section 90 taken through 5-5 of FIG. 4 is secured to the wood frame 92 by screw 94 which passes through an opening in wall 96 of chamber 98. A hole 100, which may be circular, is provided in wall 102 for insertion of screw 94 and advancement of the same into frame 92.

Referring to FIG. 6, which is taken through 6-6 of FIG. 4, a sill frame section 114 is secured to wood framing section 112 by screw 115 which has plastic element 116 disposed between the head of the screw 115 and the interior surface of chamber defining wall 116. An opening 120 is provided for access to introduce the screw 114 and advance the same. Additional screw-plastic element constructions (not shown) may be provided at relative spaced locations such as 117,118 (FIG. 4), for example.

Figure 7:
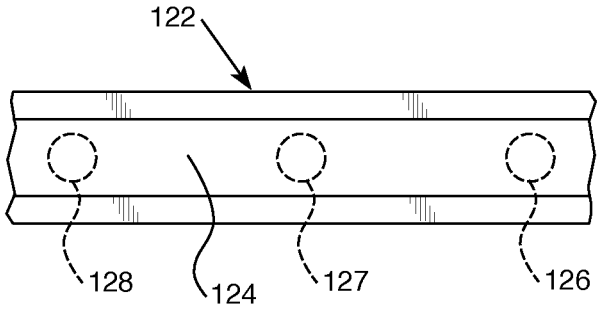
FIG. 7 is a fragmentary plan view of a portion of a sill frame section of the present invention.

Referring to FIG. 7, there is shown a fragmentary portion in plan taken through 7-7 of FIG. 4, of a sill frame section 122 which shows schematically the elongated plastic element 124 which overlies a series of relatively spaced first openings 126, 127, 128.

Figure 8:
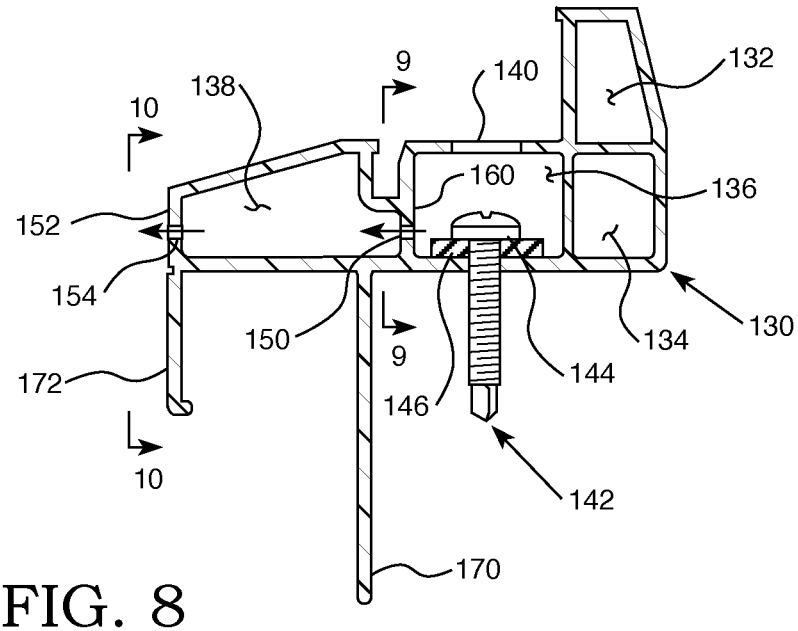
FIG. 8 is a cross-sectional view of a form of sill construction of the present invention.

FIG. 8 is a cross-sectional illustration showing a sill frame section 130 having multiple hollow chambers 132,134,136 and 138. Screw 142 has its head 144 overlying and compressing plastic element 146. Hollow chamber wall 160 as shown in FIG. 8 has a drainage opening 150.

Referring to FIG. 8, wall 152 of chamber 138 also has a drainage opening 154 permitting flow to the outside of the sill frame section 130 thereby avoiding flow into undesired areas. It will be appreciated that while single drainage openings 150, 154 have been illustrated in FIG. 8 in practice, there will be a series of similar or identical openings relatively spaced along the length of the sill frame section 130 to facilitate drainage throughout. Nailing flanges 170 and J-channel 172 are provided.

Figure 9:
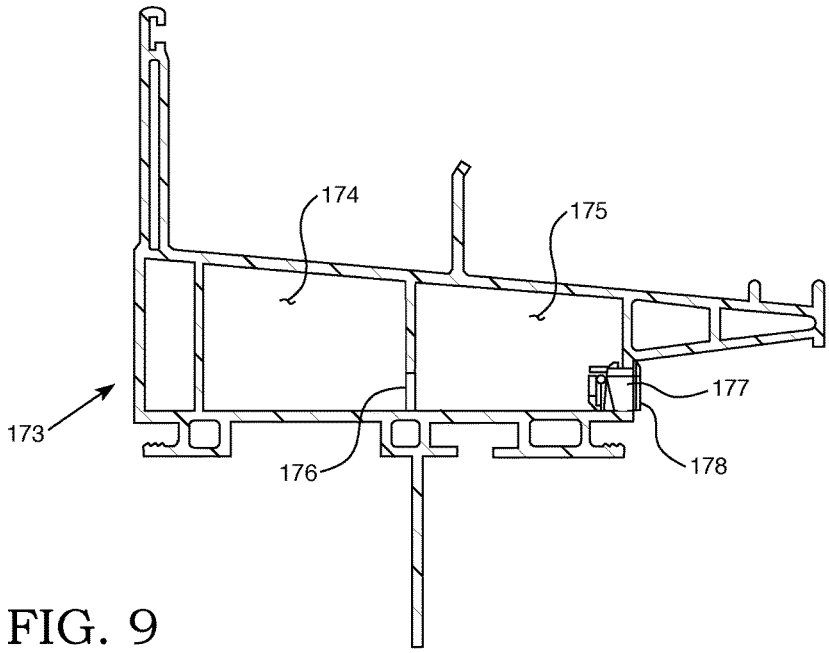
FIG. 9 is a is a cross-sectional illustration of another embodiment of the sill construction of the present invention showing a water drainage opening.

FIG. 9 shows a sill frame section 173 which has hollow chambers 174, 175 and a drainage opening 176 connecting the chambers 174, 175. There is also shown a drainage opening 177 to the exterior which is provided with a removable weep cover 178.

Figure 10:
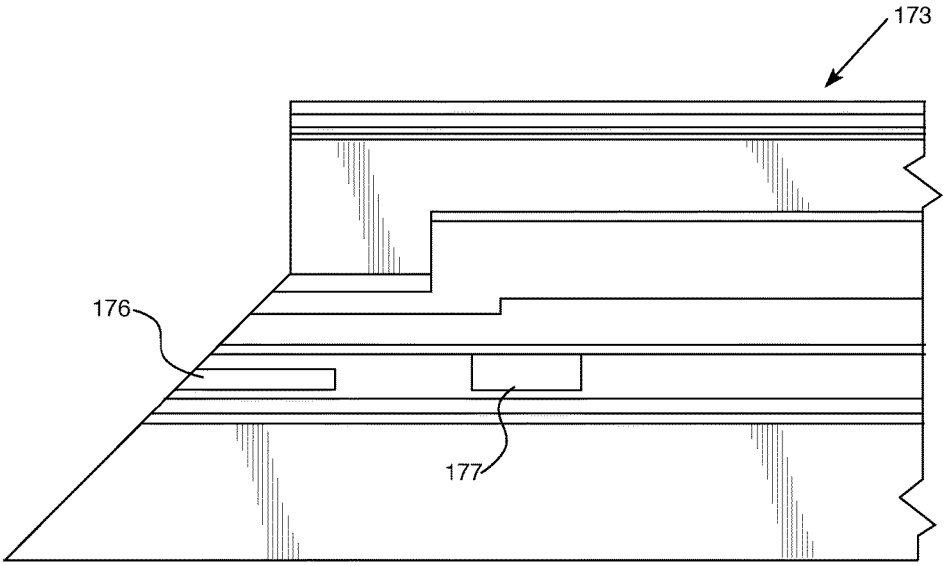
FIG. 10 is a is a front elevational view partially broken away of a portion of the sill of FIG. 9.

As shown in FIG. 10, the drainage opening 176 is through an inner wall, while the drainage opening 177 is open to the exterior of sill frame section 173. While the size and shape and spacing between relative locations may vary depending upon the preferences as to a particular installation, the drainage openings such as 176 and 177 may be generally rectangular in shape and have a dimension of about ¼ inch to 1½ inch.

Figure 11:
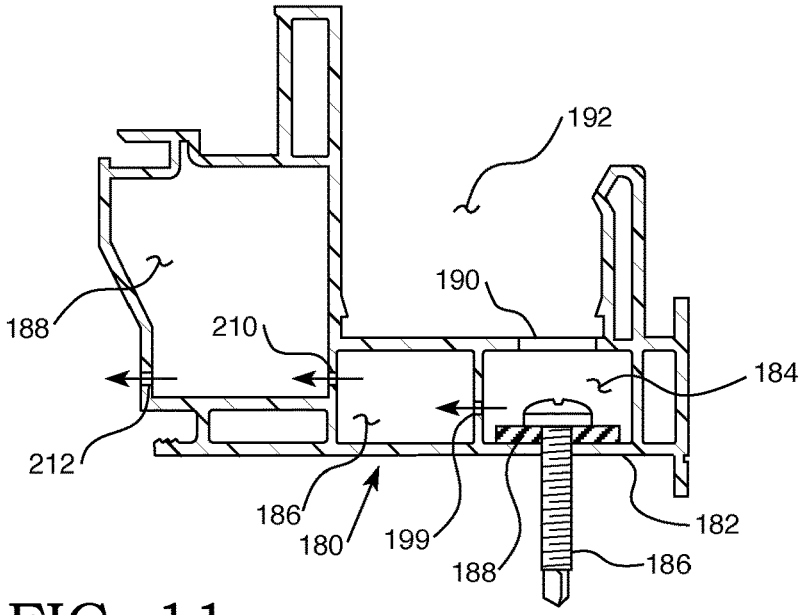
FIG. 11 is a cross-sectional illustration of another form of sill construction of the present invention having multi-chambered hollow portions.

Referring to another embodiment of the sill construction, FIG. 11 shows an extrusion 180 which has chambers 184, 186 and 188. A first opening is provided in the lower wall defining chamber 184 with screw 186 passing therethrough and plastic element 188 being compressed between the head of screw 186 and the interior surface of wall 182. This embodiment has an opening 190 through which water trapped within channel 192 may flow into chamber 184. Opening 199 provides a flow path for water to drain from chamber 184 to chamber 186. Similarly, opening 210 permits flow of water from chamber 186 to chamber 188. Drainage opening 212 permits flow of water from chamber 188 to the exterior of the extrusion.

Figure 12:
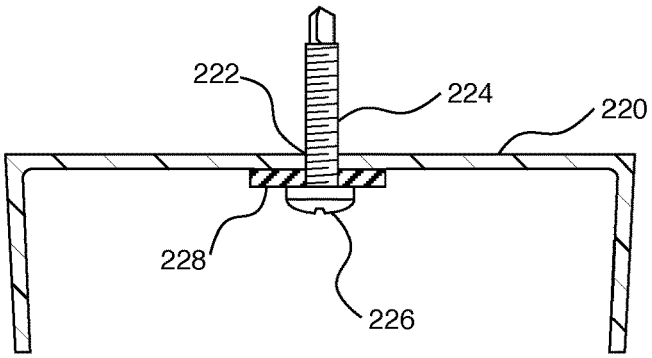
FIG. 12 is a cross-sectional illustration of a portion of the head expander of the window of FIG. 4.

FIG. 12 is a section through the head expander taken through 12-12 of FIG. 4 and shows an inverted channel 220 defining an opening 222 with screw shank 224 to be secured to the adjacent wood frame with the screw head 226 compressing plastic element 228. The sealing features of the present invention not only resist leakage in the head to seal against undesired water leakage from above through the wall cavity but, also, resists undesired sagging of the header.

Figure 13A:
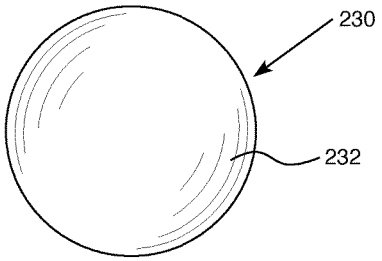
FIGS. 13 (*a*) and 13 (*b*) are respectively top plan and bottom plan views of the closure cap employed in a form of in the present invention.
Figure 13B:
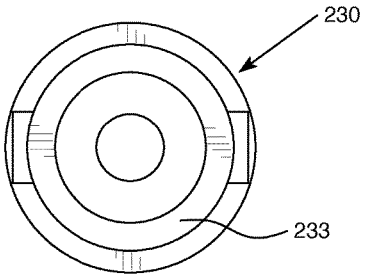
Figure 14A:
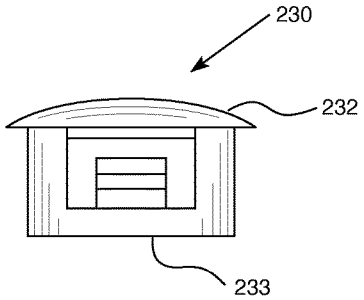
FIGS. 14 (*a*) and 14 (*b*) are respectively left side and right side elevational views of the closure cap of FIGS. 13(*a*) and 13(*b*).
Figure 14B:
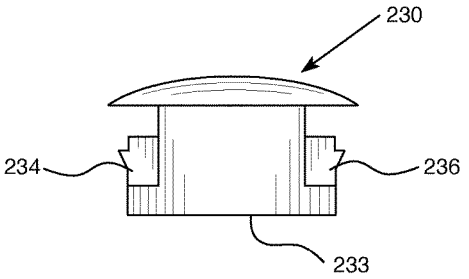

FIGS. 13(*a*) and 13(*b*) illustrate a form of closure cap 230. The closure cap 230 has a top surface 232 and a bottom surface 233. As shown in FIGS. 14(*a*) and 14(*b*), outwardly projecting ribs such as 234, 236 which facilitate intimate engagement with the opening in which it will be received.

Figure 21:
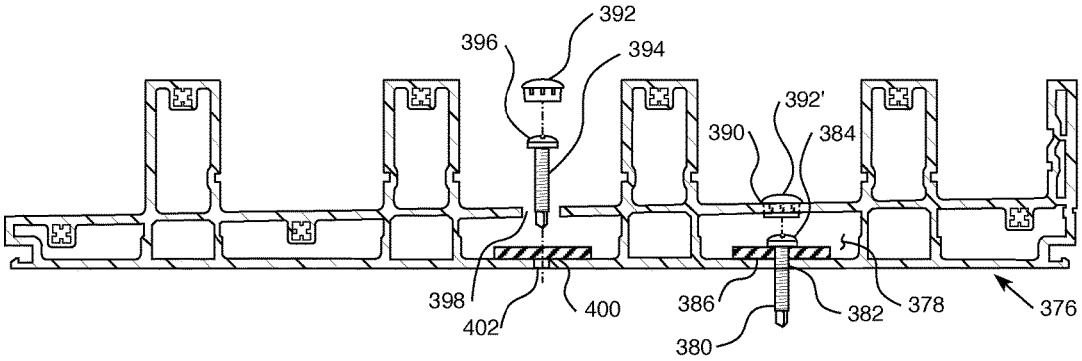
FIG. 21 is a partial cross-sectional illustration of a four track patio door that holds eight sashes. The closure caps are shown in elevation with one being in its final position and another being in an exploded view. In this construction, the water drains from right to left through weep holes.

The closure cap, as shown in FIGS. 13(*a*) and (*b*) and 14 (*a*) and (*b*), is structured to seal the opening overlying the screw head in final position, as shown in FIG. 21, with the exploded position of the closure cap 392 shown toward the center of that drawing and the closure cap 392' shown seated in an opening for sealing the structure. Closure cap 392 is received in opening 398 after screw shank 394 passes through plastic element 400 and opening 402 with head 396 compressing plastic element 400. Closure cap 392, when shown in seated position, serves to seal hollow chamber 378 and resist undesired entry of moisture or foreign matter. Closure cap 392 is preferably a solid plug. It is preferably composed of a resilient material so as to fit within opening 390 intimately and may be made of polyvinyl chloride.

Figure 15:
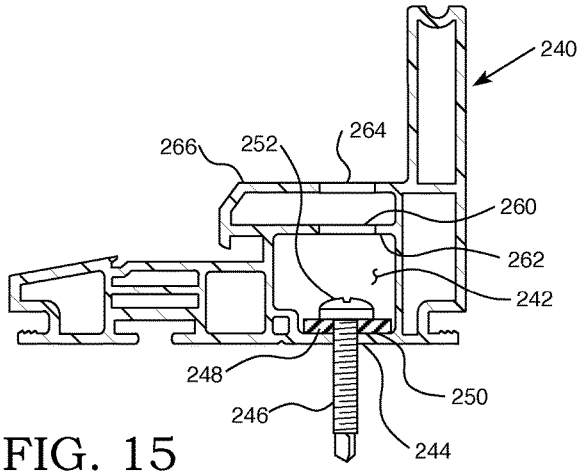
FIG. 15 is a cross-sectional view of another form of multi-chambered hollow sill member usable in a casement window.

Referring to FIG. 15, there is shown a modified form of sill extrusion 240 which has a hollow chamber 242 and a first opening 244 through which screw shank 246 passes. This embodiment may be used in a casement window. Plastic element 248 is secured between the inner surface of lower wall 250 which partially defines hollow chamber 242 and the undersurface of screw head 252. First opening 260 is provided in wall 262 and is an overlying aligned relationship with first opening 244 and screw 246 and permits screw 246 to pass therethrough. A second opening 264 is aligned with and overlies first opening 260 in wall 266. Closure cap as shown is FIGS. 13 and 14 will be inserted into second opening 264.

Figure 16:
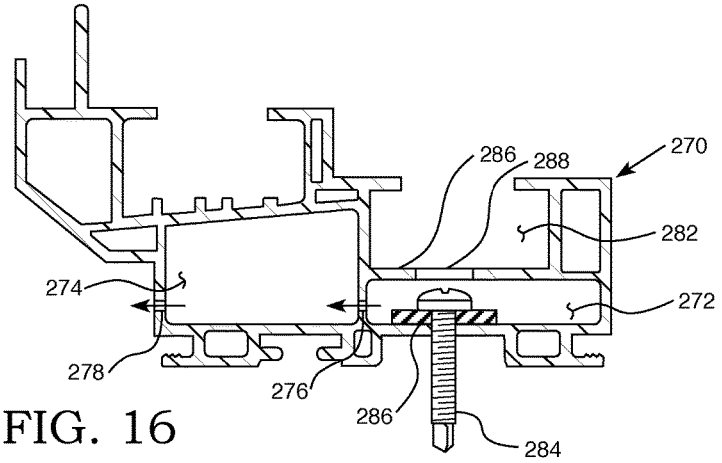
FIGS. 16 through 20 show different embodiments of the multi-chambered sill construction.

Referring to FIG. 16, there is shown a further modified form of sill frame section 270 which may be used in a sill, jamb and head of a double hung window. It has chambers 272 and 274 with respective drainage openings 276,278. Flow opening 288 is provided to allow water from channel 282 to flow into chamber 272 and from there to chamber 274 and then to flow outside of the extrusion. Screw 284 cooperates with plastic element 286 to provide the desired sealing with opening 288 permitting introduction of the same. Other frame sills are shown in FIGS. 17 through 20 and will be described hereinafter.

Figure 17:
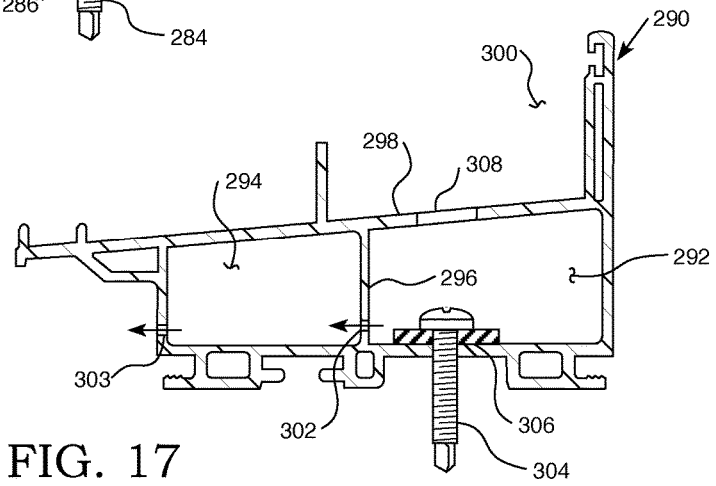

FIG. 17 shows a form of sill frame section 290 which has hollow chamber 292, hollow chamber 294 and dividing wall 296 and is suitable for use in a double hung window. An opening in 298 for water entry from channel 300 permits water to enter the extrusion in hollow chamber 292 and to pass through wall 296 through drainage opening 302 and ultimately, to be discharged to the exterior through drainage opening 303. Screw 304 and plastic element 306 cooperate to seal the opening through which shank of screw 304 passes. A second opening 308 permits access for insertion and advancement of the screw 304 and also is structured to receive closure 230.

Figure 18:
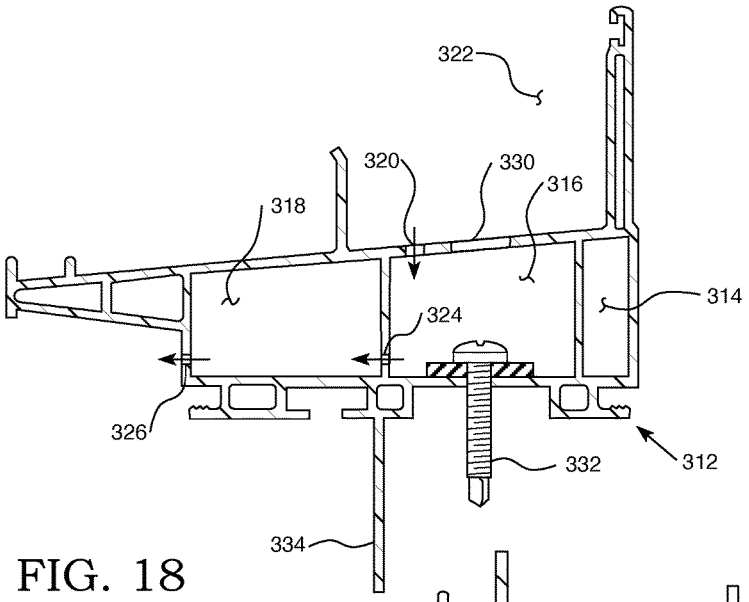

Referring to FIG. 18, there is shown a further embodiment of a sill frame section 312 which has hollow chambers 314, 316, and 318. Water entering through flow opening 320 in channel 322 to enter chamber 316 with water passing from that chamber through drain opening 324 into chamber 318 and ultimately, to be discharged to the exterior through drain opening 326. Opening 330 permits access for insertion of screw 332 and insertion the closure (not shown). Nailing fin 334 is provided.

As shown in FIGS. 17 and 18, the sill construction slopes from the right-hand portion which is adjacent to the building toward the left-hand portion which is adjacent the exterior.

Figure 19:
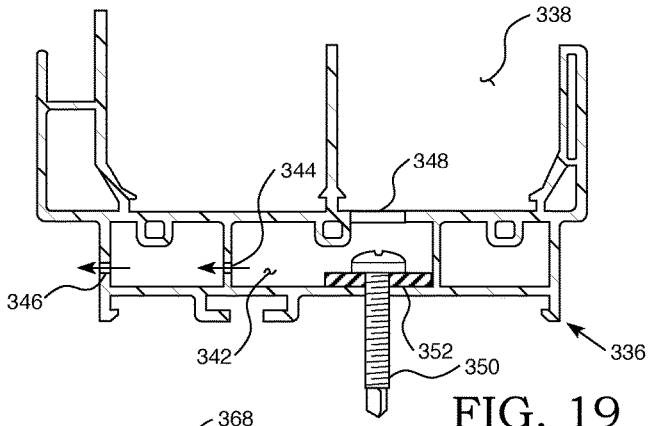

Referring to FIG. 19, there is a further embodiment of sill frame section 336 which may be used in a slider window. It has an upwardly open channel 338 with a flow opening 340 facilitating flow of water from the channel 338 into chamber 342 and through drain openings 344 and 346 to the exterior of the building. First opening 348 and associated screw 350 and plastic element 352 are shown.

Figure 20:
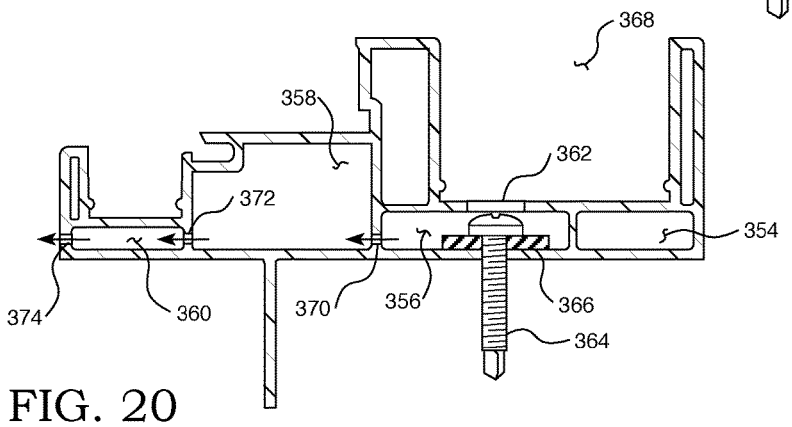

Referring to FIG. 20, there is shown another embodiment of a sill construction which may be used in a patio door. There are a plurality of hollow chambers including chambers 354, 356, 358, 360. A first opening 362 for introduction and advancement of screw 364 is provided. Plastic element 366 has been coextruded with the extrusion. In this embodiment, channel 368 has a first opening 370 to allow water to flow from the channel 368 through first opening 370 into chamber 356 and through drain openings 370, 372, 374 to the exterior.

FIG. 21 is a cross-sectional illustration of sill extrusion 376 with a portion shown schematically. With respect to chamber 378, screw shank 380 passes through a first opening located at 382 and has its head 384 placing the plastic element 386 in compression. Overlying closure which preferably is in the nature of the resilient plug 392' such as shown in FIGS. 13 (*a*) and (*b*) and 14 (*a*) and (*b*), is positioned within opening 390 to seal the same. Closure cap 392 after the screw 394 passes through is seated in opening 398. This figure also provides an example of a pair of spaced screw receiving openings 382,402 underlying plastic element 386, 400. The closure not only serves to resist undesired entry of water and airborne dirt but, also, resists sound passage and enhances the aesthetic appearance of the sill extrusion.

Figure 22:
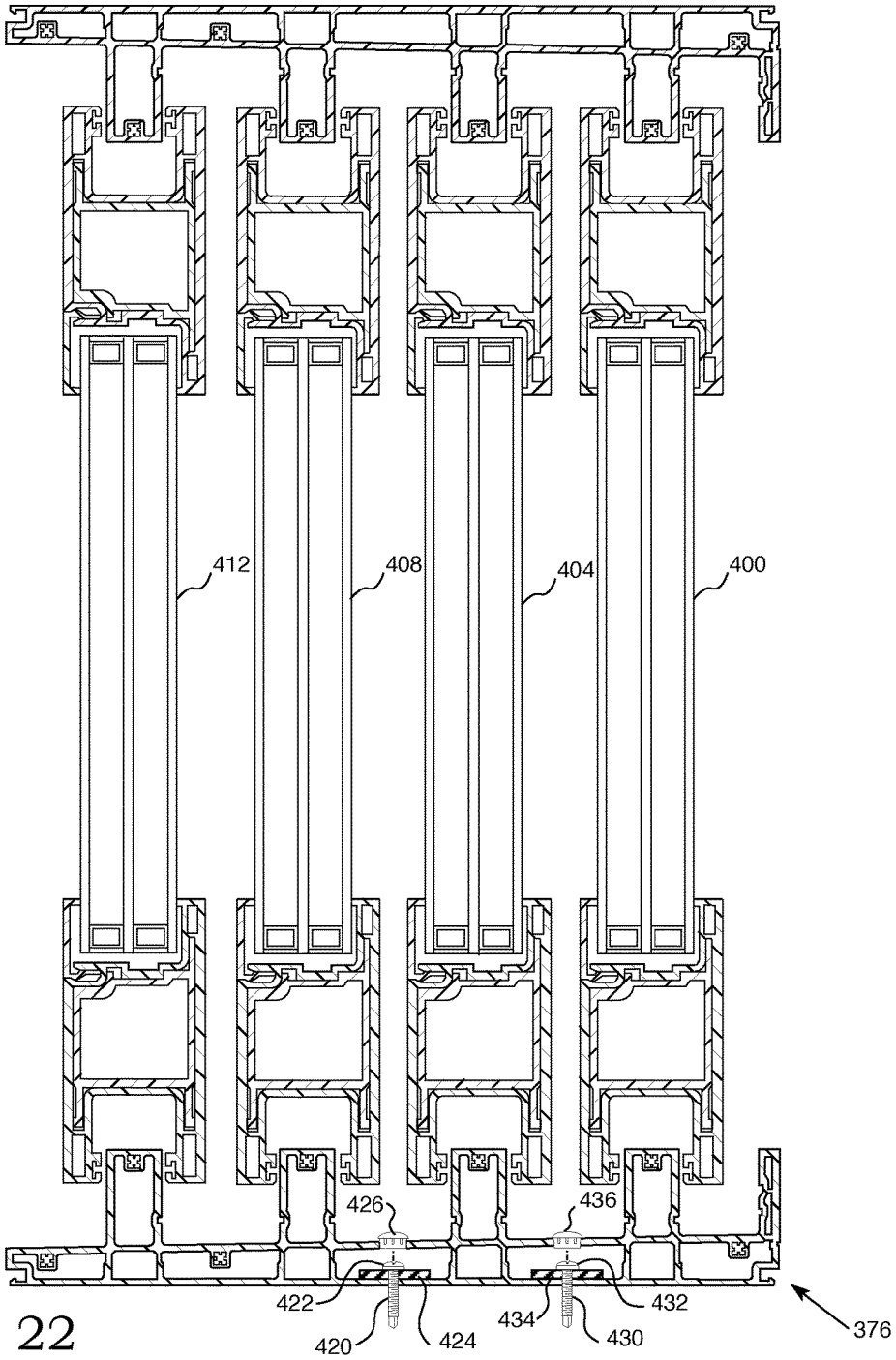
FIG. 22 is a cross-sectional illustration of the sill of FIG. 21 showing four patio doors each having two sashes with the water draining from left to right.

FIG. 22 illustrates the sill extrusion 376 of FIG. 21 which is structured to be in a four track door with sill covers to enhance the appearance of the same. Doors 400, 404, 408, 412 are illustrated. By way of example, screw 420 has screw head 422, and compression plastic element 424. With closure cap 426 seated within an opening, screw 430 has its head 432 compressing plastic element with closure cap 436 seated within an opening.

The method of the present invention may provide the structures disclosed herein. The method involves providing a window or door having a sill provided with a sill frame section having at least one hollow chamber. A plastic element is secured to the sill frame section on a wall of the hollow chamber which provides one or more openings for a fastener to pass through the opening and have its head compress the plastic element so as to seal the opening against undesired water leakage through the opening. Elated jamb and head constructions may also be provided.

The method may involve the use of the plurality of preformed holes spaced relatively along the extrusion and cooperating with a plurality of fasteners receiving openings and the plastic element. The openings for receipt of the fasteners which preferably will be screws, may be preformed in the extrusion or may be created by advancement of the screws through the material.

It will be appreciated from the foregoing that the present invention provides various forms of sill constructions for windows and doors and the like, which permit the use of fasteners which pass through the sill and are secured to another building component while providing positive sealing action. This serves to resist undesired entry of water, air and sound into portions of the building. It further permits drainage of water contained with upwardly open channel portions of a sill frame section wherein water might otherwise accumulate. Various structural arrangements for sills having hollow chambers with some of the chamber defining walls serving to facilitate transport of water to the exterior of the sill frame section and also providing strength as in compressive loading on generally vertical portions of the sill frame section in order to minimize glass deflection under load. The structures also facilitate employing the number, shape and design of the hollow chambers so as to meet dimensional and loadbearing design specifications while permitting efficient discharge of undesired water along the length of the sill member. Related jamb and head constructions are also provided.

Whereas particular embodiments of the invention have been disclosed herein for purposes of illustration, it will be appreciated by those skilled in the art that numerous variations of the details may be made without departing from the invention as described in the appended claims.

What is claimed is:

1. A sill for a window or door having a frame and a panel comprising, said frame having an elongated sill frame section defining at least one hollow chamber, said sill frame section being a vinyl frame, at least one first opening in said sill frame section, a fastener having a fastener head and a shank projecting therefrom, said shank passing through said first opening securing said sill frame section to an adjacent structural member, a flexible, compressible plastic element being coextruded to an interior surface of a wall of a said hollow chamber of said vinyl frame, and said a flexible, compressible plastic element sealingly disposed between said fastener head and said interior surface of a wall of said hollow chamber.

2. The sill of claim 1 including, said sill frame section being a rigid vinyl extrusion.

3. The sill of claim 1 including, said flexible, compressible plastic element receiving a plurality of said fasteners in a plurality of relatively spaced first openings spaced along said sill frame section.

4. The sill of claim 1 including, said flexible, compressible plastic element having an uncompressed thickness of about 0.040 to 0.250 inch.

5. The sill of claim 1 including, said first opening being preformed in said sill frame section.

6. The sill of claim 1 including, said first opening being formed by said fastener penetrating said sill frame section.

7. The sill of claim 1 including, said sill frame section having a plurality of said hollow chambers.

8. The sill of claim 1 including, a second opening in said sill frame section generally overlying and aligned with said first opening, and a closure inserted into said second opening.

9. The sill of claim 7 including, said fastener, said flexible, compressible plastic element and said sill frame section providing resistance to passage of water and air from said hollow chambers through said first opening.

10. The sill of claim 1 including, at least one drain opening in a wall of a said hollow chamber to permit discharge of water from said chamber.

11. The sill of claim 7 including, said hollow chambers having a series of drain openings to facilitate water drainage to the exterior of said frame section.

12. The sill of claim 11 including, said sill being a door sill having an upwardly open channel, and said sill frame section having at least one entry opening permitting entry of water from said sill upwardly open channel to the interior of said hollow chamber for draining said external water from said frame section.

13. A method of installing a sill for a window or a door having a frame and a panel comprising, providing a sill frame section having at least one hollow chamber provided with a flexible, compressible plastic element secured to an interior surface of a wall of said hollow chamber overlying at least one first opening in said wall, said flexible, compressible plastic element being, secured to said sill frame section by coextrusion, said sill frame section being a rigid vinyl frame section, providing a fastener with a head and a shank projecting therefrom, passing said fastener shank through said first opening in said wall of said hollow chamber with said plastic element sealingly secured between said fastener head and said interior wall, and securing said fastener shank to an exteriorly disposed member.

14. The method of claim 13 including, providing said flexible, compressible plastic element with sufficient length to receive a plurality of relatively spaced said fasteners passing therethrough and through a plurality of spaced said first openings.

15. The method of claim 13 including, creating said first opening prior to passing said fastener through said wall.

16. The method of claim 13 including, creating said first opening during passage of said fastener through said wall.

17. The method of claim 13 including, said sill frame section being a vinyl extrusion.

18. The method of claim 13 including, establishing said sill frame section with a plurality of said hollow chambers.

19. The method of claim 13 including, providing at least one drain opening to facilitate discharge of water from said sill frame section to the exterior of said sill frame section.

20. The method of claim 19 including, at least one drain opening provided in an internal wall for facilitating discharge of the water to the exterior of said sill frame section.

21. The method of claim 13 including, said sill being a door sill having an upwardly open channel, and providing an entry opening into said hollow chamber to permit external water to pass from said channel to said entry opening to enter said chamber for discharge from said sill frame section.

22. A frame for extruded window or door comprising, said frame having a rigid extruded vinyl sill am section, two jamb frame sections and a head section, said jamb frame section being elongated and defining at least one hollow chamber, each said jamb frame section having a fastener having a fastener head and a shank projecting therefrom, at least one first opening in each said jamb frame section, said shank passing through said first openings and securing said jamb frame sections to an adjacent member, each said jamb frame section having a flexible, compressible plastic element sealingly disposed between said fastener head and an interior surface of a wall of said hollow chamber to resist flow of water through said first opening, and said flexible, compressible plastic element being coextruded with an interior surface of a wall of said hollow chamber.

23. The frame of claim 22 including, said head section being an inverted channel having a said first opening through which said fastener extends, and each said fastener head compressing a said plastic element.

* * * * *